US005667015A

United States Patent [19]

Harestad et al.

[11] Patent Number: 5,667,015

[45] Date of Patent: Sep. 16, 1997

[54] WELL BARRIER

[75] Inventors: Kristian Harestad, Randaberg; Thor-Peter Herigstad, Bryne, both of Norway

[73] Assignee: BJ Services Company, Houston, Tex.

[21] Appl. No.: 587,157

[22] Filed: Jan. 16, 1996

[30] Foreign Application Priority Data

Feb. 3, 1995 [NO] Norway ..... 950396

[51] Int. Cl.[6] ..... E21B 33/126; E21B 33/134; E21B 33/136

[52] U.S. Cl. ..... 166/383; 166/153; 166/285; 166/386

[58] Field of Search ..... 166/153, 170, 166/172, 285, 291, 383, 386; 15/104.061

[56] References Cited

U.S. PATENT DOCUMENTS

| | | | |
|---|---|---|---|
| 1,687,424 | 10/1928 | Boynton | 166/285 X |
| 1,979,802 | 11/1934 | Kinley . | |
| 2,179,812 | 11/1939 | Calkins | 166/153 |
| 2,187,480 | 1/1940 | Baker . | |
| 2,618,345 | 11/1952 | Tucker . | |
| 2,646,845 | 7/1953 | Schillinger . | |
| 2,672,200 | 3/1954 | Patterson . | |
| 2,969,839 | 1/1961 | Greene | 166/63 |
| 3,070,167 | 12/1962 | Loy, III et al. | 166/153 |
| 3,109,491 | 11/1963 | Solum et al. | 166/172 |
| 3,385,368 | 5/1968 | Solum et al. | 166/202 |
| 3,633,673 | 1/1972 | Conrad | 166/291 |
| 3,891,034 | 6/1975 | Owen et al. | 166/285 |
| 3,955,625 | 5/1976 | Hughes et al. | 166/202 |
| 4,275,788 | 6/1981 | Sweatman | 166/285 X |
| 4,421,169 | 12/1983 | Dearth et al. | 166/285 |
| 4,491,178 | 1/1985 | Terrell et al. | 166/192 |
| 4,495,997 | 1/1985 | Scott et al. | 166/285 |
| 4,501,327 | 2/1985 | Retz | 166/285 |

OTHER PUBLICATIONS

R. W. Scott: "How through-tubing bridge plugs work", World Oil, Oct. 1959, vol. 149, No. 5., pp. 141–149.

Downhole Talk, BP Monthly Newsletter, Jan. 1996, Issue 54, pp. 2–3.

Running Procedure for The Para Bow Cementing Tool, BJ Services AS, Aug. 1995, Brochure, Norway.

The Para Bow Cementing Tool, BJ Services Company, Aug. 1995, Brochure, Norway.

*Primary Examiner*—George A. Suchfield

*Attorney, Agent, or Firm*—Arnold, White & Durkee

[57] ABSTRACT

A well barrier for separating two liquids in a gas or oil well. The well barrier includes opposing sets of laths which project slantingly away from a centrally positioned fixing device. A set of upper and lower canvas materials may be affixed to each of the sets of laths to provide enhanced sealing effect. Preferably, the laths are also positioned in an overlapping relationship to thereby minimize the overall length of the well barrier while also maintaining the required functionality.

8 Claims, 5 Drawing Sheets

WELL BARRIER

FIELD OF THE INVENTION

The invention relates generally to oil exploration. The invention relates specifically to an apparatus for establishing a division between two liquids in an oil well, especially with regard to the installation of a cement plug.

BACKGROUND OF THE INVENTION

As is well known, an oil or gas well can be divided into an upper and a lower part by means of a cement plug which is installed by adding a cement mixture through a supply pipe which ends where the plug is to be located. When the cement mixture is in place, the supply pipe is withdrawn from the cement mixture. The cement mixture is then left alone to harden.

Prior to adding the cement mixture, the well is filled with a liquid, typically a drilling fluid, with a density adjusted to the formation pressure. The cement plug is usually located well above the bottom of the well, and the cement mixture is carried by the drilling fluid until the cement mixture is hardened.

The cement mixture typically has a greater density than the drilling fluid, and the cement mixture therefore tends to sink into the drilling fluid. As a result, a common failure mode for cement plug installations is that the cement plug ends up deeper in the well than planned. Another common failure mode is that the cement plug does not cover the entire cross section of the well resulting in the cement plug coming loose. Occasionally, the cement plug also does not obtain the specified hardness because of its mixing with drilling fluid.

The failure modes often present with cement plug installations are first and foremost due to the fact that the cement mixture has a tendency to sink in one part of the cross section of the well while displaced drilling fluid at the same time rises to the surface through an other part of the cross section of the well. In a vertical well this results in a downward stream of cement mixture and an upward stream of displaced drilling fluids through various parts of the cross section of the well. The result of this is, as previously mentioned, the cement mixture sinks to a much lower level than where the supply pipe ends, and the cement mixture does not cover the whole cross section of the well and the cement mixture is diluted with drilling fluid which reduces its quality.

Thus, in order to secure the formation of a cement plug, it is important to distribute the cement mixture over the whole cross section of the well and to prevent blending with the drilling fluid. An evenly distributed cement mixture prevents the drilling fluid below from escaping to the surface, and a more dense cement mixture floats on top of the drilling fluid below.

One known method of improving cement plug formation is to arrange radial discharge openings in the cement charge pipe in order to distribute the cement mixture evenly around the cross section of the well. It is also a known method to direct the above mentioned discharge openings in an upwards angle to ensure that the cross section of the well is covered with cement mixture prior to a downward movement. Efforts of this type have, however, only limited effects. As mentioned earlier, cement plugs in practice continue to be located deeper than planned, do not cover the entire cross section of the well, or they are too soft. In practice this is typically corrected by building a second cement plug on top of the first one. The result is usually satisfactory, but the cost is unnecessarily high.

It is also known to arrange a well barrier which divides the liquid column in the well into two parts and then supply a cement mixture on top of the well barrier.

A secure well barrier can, with known technology, be achieved by mounting a mechanical plug in the well. It is however time consuming and costly to mount such a mechanical plug, and such known plugs can only be used in the lined part of the well where cross section and other dimensions are known.

One known well barrier which is independent of well diameter and cross section consists of a jelly-like liquid with a density equal to the density of the drilling fluid. The jelly-like liquid will neither sink nor rise, but form a jelly plug. The jelly-like liquid is thixotropic and will harden after a while, but it may take hours before the cement mixture can be poured on top of the jelly plug. A jelly-like liquid which will harden in contact with the cement mixture or its additives is also known.

After the cement mixture is supplied, it is necessary to wait several hours before the location of the plug can be determined and further work be undertaken. By known technology it typically takes 36 hours to complete the setting of a plug as described above.

The present invention is directed to overcoming, or at least reducing the effects of, one or more of the problems set forth above. In particular, the present invention provides a well barrier which can be mounted in a short period of time and which reduces the total time consumed in mounting a cement plug. It further provides a well barrier that ensures the correct location of the cement plug within the well. It still further provides a well barrier that can be mounted in an unlined well and that can be used for large number of well diameters.

SUMMARY OF THE INVENTION

In accordance with one aspect of the present invention, a well barrier is provided which forms a plug-like body adapted to rest against the wall of the well and includes two sets of crossing laths which project slantingly from each end of the well barrier and are adapted to rest against the wall of the well.

BRIEF DESCRIPTION OF THE DRAWINGS

The present invention will become more fully understood from the following detailed description of the preferred embodiments, taken in conjunction with the accompanying drawings in which.

DETAILED DESCRIPTION OF THE INVENTION

A well barrier is presented that is easily positioned and effective in separating fluids within a well. A method of positioning the well barrier is further presented which allows the well barrier to be positioned at the desired location within the well.

Figure 1:
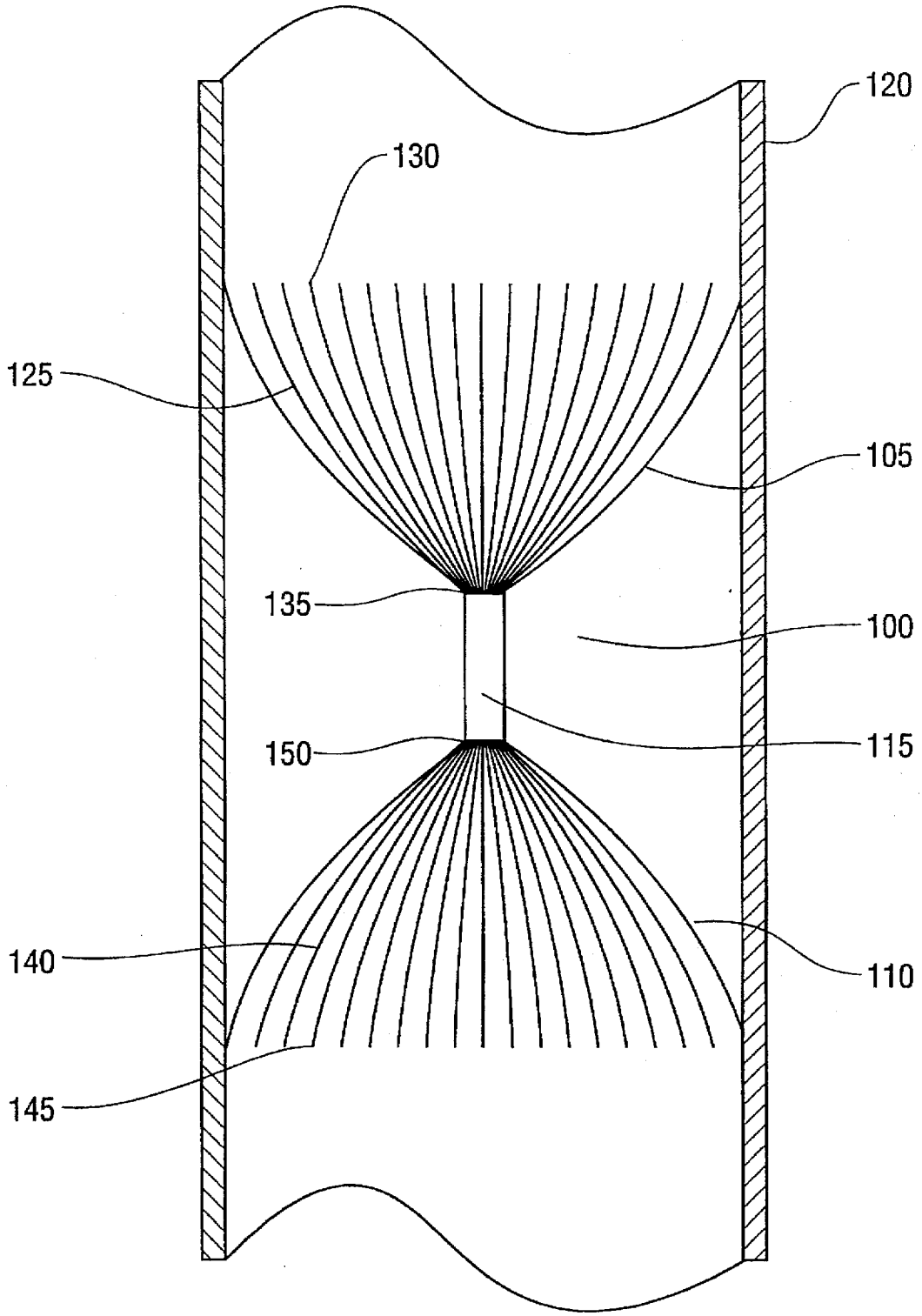
FIG. 1 illustrates a first embodiment of a well barrier positioned within a well.

Turning now to the drawings, and referring initially to FIG. 1, a first embodiment of a well barrier 100 includes a first set of laths 105, a second set of laths 110, and a fixing device 115. In use, the well barrier 100 is positioned within a well 120 at a desired depth location with the first set of laths 105 and the second set of laths 110 in contact with the wall of the well 120.

The first set of laths 105 include a plurality of laths 125 circumferentially distributed about the longitudinal centerline of the fixing device 115. Each of the laths 125 include first 130 and second ends 135. The laths 125 are attached to the fixing device 115 at their second ends 130. The first ends 130 of the laths 125 project slantingly away from the fixing device 115 at an angle to the longitudinal centerline of the fixing device 115.

The second set of laths 110 include a plurality of laths 140 circumferentially distributed about the longitudinal centerline of the fixing device 115. Each of the laths 140 include first 145 and second end 150. The laths 140 are attached to the fixing device 115 at their second ends 150. The first ends 145 of the laths 140 project slantingly away from the fixing device 115 at an angle to the longitudinal centerline of the fixing device 115.

The two sets of laths, 105 and 110, are therefore shaped like two cones pointing their respective tops against each other. The laths 125 and 140 may comprise resilient materials such as, for example, spring steel. The fixing device 115 may comprise materials suitably resistant to the environment within the downhole region of the well.

When the well barrier 100 is placed in a well 120 which is filled with a drilling fluid with high viscosity, the second set of laths 110 will prevent the well barrier 100 from sinking in the well 120. By an eventual movement downward, the fluid underneath the second set of laths 110 will force the laths 140 out against the wall of the well 120 because the distance between the laths 140 is such that it is difficult for the liquid to pass through. The cement mixture is poured on top of the first set of laths 105 and thereby forces the laths 125 out against the wall of the well 120. The distance between the laths 125 is such that the cement mixture hardly can pass through. The leakage of the cement mixture through the laths 125 will therefore be a minimum and the leakage of drilling fluid through the laths 140 will also be a minimum. Consequently, the well barrier 100 will remain in place and secure that the cement mixture remains in place and that it covers the entire cross section of the well 120.

In practice, the differential pressure between the upper and lower ends of the well barrier 100 is typically relatively small, and using liquids with high viscosity such as cement mixtures and some drilling fluids, openings between the laths, 125 and 140, of the first and second set of laths, 105 and 110, can be permitted without reducing the effectiveness of the well barrier 100. The laths, 125 and 140, of the first and second set of laths, 105 and 110, may also, by known fabrication methods, be arranged with flat bands, partly overlapping each other, in order to create an enhanced sealing effect.

If a drilling fluid and/or a cement mixture with relatively low viscosity is used, it may be necessary to arrange for extra sealing between laths, 125 and 140, of the first and second set of laths, 105 and 110.

Figure 2:
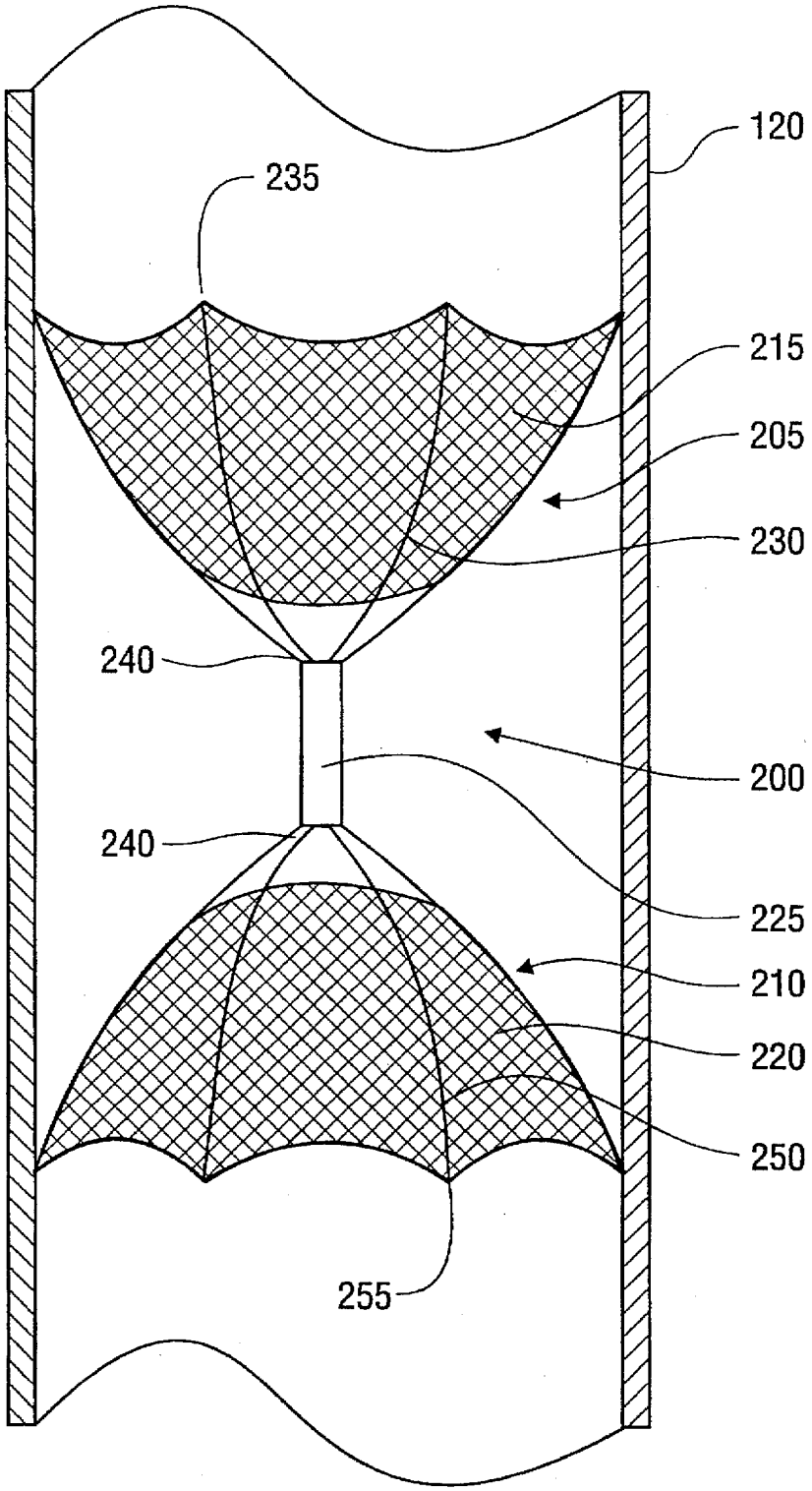
FIG. 2 illustrates a second embodiment of a well barrier positioned within a well.

Referring now to FIG. 2, a second embodiment of a well barrier 200 includes a first set of laths 205, a second set of laths 210, a first canvas material 215, a second canvas material 220, and a fixing device 225. In use, the well barrier 200 is positioned within a well 120 at a desired depth location with the first set of laths 205 and the second set of laths 210 in contact with the wall of the well 120. The addition of the first and second canvas materials, 215 and 220, to the first and second set of laths, 205 and 210, provides enhanced sealing effect especially effective for sealing off low viscosity fluids.

The first set of laths 205 include a plurality of laths 230 circumferentially distributed about the longitudinal centerline of the fixing device 225. Each of the laths 230 include first 235 and second ends 240. The laths 230 are attached to the fixing device 225 at their second ends 240. The first ends 235 of the laths 230 project slantingly away from the fixing device 225 at an angle to the longitudinal centerline of the fixing device 225.

The second set of laths 210 include a plurality of laths 250 circumferentially distributed about the longitudinal centerline of the fixing device 225. Each of the laths 250 include first 255 and second end 260. The laths 250 are attached to the fixing device 225 at their second ends 260. The first ends 255 of the laths 250 project slantingly away from the fixing device 225 at an angle to the longitudinal centerline of the fixing device 225.

The two sets of laths, 205 and 210, are therefore shaped like two cones pointing their respective tops against each other. The laths 230 and 250 may comprise resilient materials such as, for example, spring steel. The fixing device 225 may comprise materials suitably resistant to the environment within the downhole region of the well.

The first and second set of laths, 205 and 210, include first and second canvas materials, 215 and 220. The canvas materials, 215 and 220, are strapped between the laths, 230 and 250, of the first and second set of laths 205 and 210. The resulting structure of the well barrier 200 is similar in appearance to a pair of umbrellas which are arranged tip against tip.

In the well barrier 200, the canvas materials, 215 and 220, provide the principle sealing function. Therefore the number of laths, 230 and 250, can be reduced and the spacing between the laths, 230 and 250, can be increased. The canvas materials, 215 and 220, are preferably arranged as bags with openings at the free ends, 235 and 255, of the laths 230 and 250, so that the fixing device 225 is located between the bottoms of the two bag-like structures. The canvas materials, 215 and 220, may also comprise other materials as will be apparent to a person of ordinary skill in the art having the benefit of this disclosure.

Figure 3:
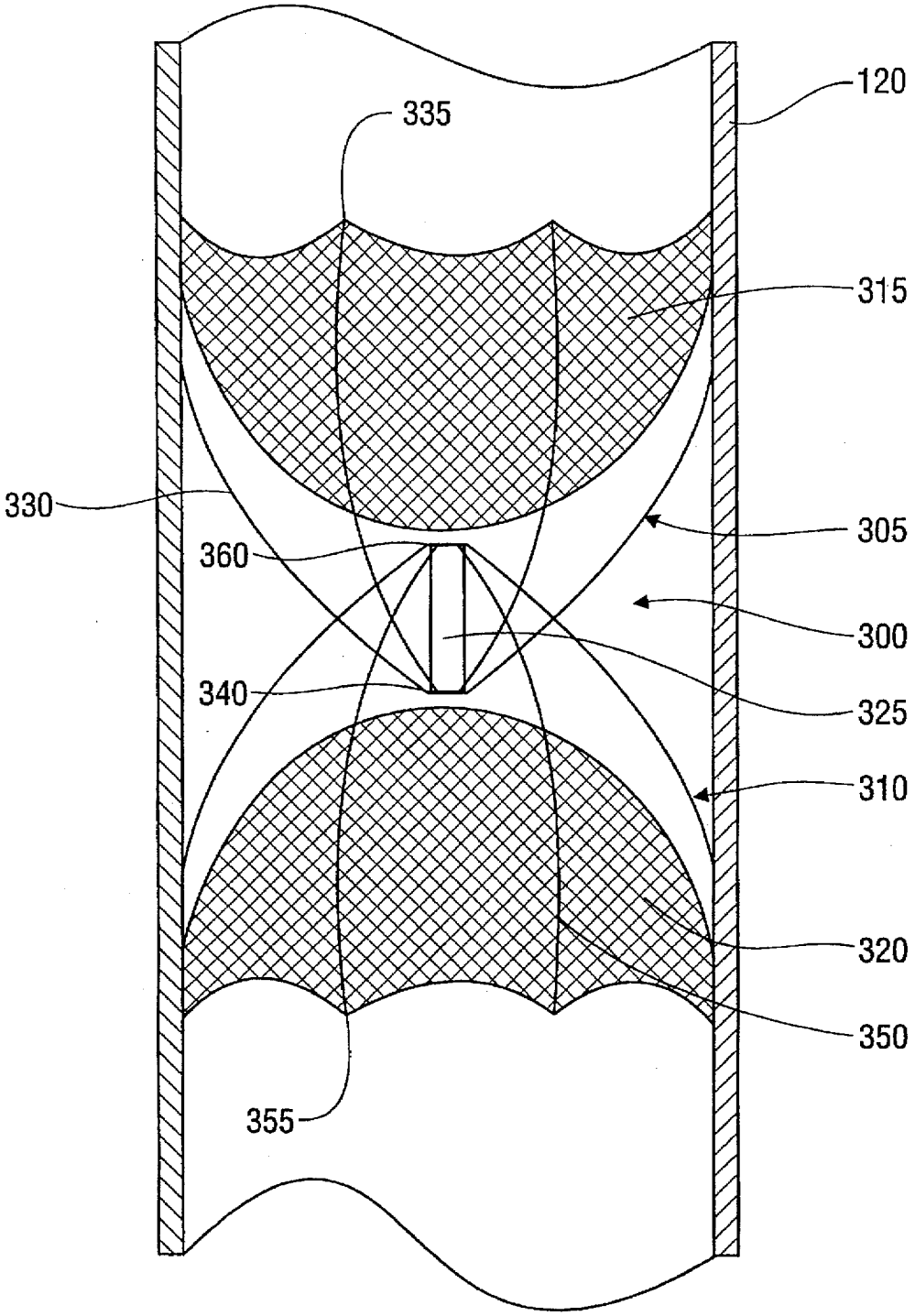
FIG. 3 illustrates a third embodiment of a well barrier positioned within a well.

Referring now to FIG. 3, a third embodiment of a well barrier 300 includes a first set of laths 305, a second set of laths 310, a first canvas material 315, a second canvas material 320, and a fixing device 325. In use, the well barrier 300 is positioned within a well 120 at a desired depth location with the first set of laths 305 and the second set of laths 310 in contact with the wall of the well 120. The addition of the first and second canvas materials, 315 and 320, to the first and second set of laths, 305 and 310, provides an enhanced sealing effect which is especially effective for sealing off low viscosity fluids. The first and second set of laths, 305 and 310, are positioned in overlapping relationship with respect to each other thereby permitting the overall length of the well barrier 300 to be reduced without sacrificing any functionality.

The first set of laths 305 include a plurality of laths 330 circumferentially distributed about the longitudinal centerline of the fixing device 325. Each of the laths 330 include first 335 and second ends 340. The laths 330 are attached to the fixing device 325 at their second ends 340. The first ends 335 of the laths 330 project slantingly away from the fixing device 325 at an angle to the longitudinal centerline of the fixing device 325.

The second set of laths 310 include a plurality of laths 350 circumferentially distributed about the longitudinal centerline of the fixing device 325. Each of the laths 350 include first 355 and second end 360. The laths 350 are attached to the fixing device 325 at their second ends 360. The first ends 355 of the laths 350 project slantingly away from the fixing device 325 at an angle to the longitudinal centerline of the fixing device 325.

The first and second set of laths, 305 and 310, are furthermore affixed to the fixing device 325 in an overlapping relationship with the laths 330 of the first set of laths 305 passing between the laths 350 of the second set of laths 310. This permits the overall length of the well barrier 300 to be minimized while at the same time maintaining its required functionality.

The two sets of laths, 305 and 310, are therefore shaped like two overlapping cones. The laths, 330 and 350, may comprise resilient materials such as, for example, spring steel. The fixing device 325 may comprise materials suitably resistant to the environment within the downhole region of the well.

The first and second set of laths, 305 and 310, include first and second canvas materials, 315 and 320. The canvas materials, 315 and 320, are strapped between the laths, 330 and 350, of the first and second set of laths 305 and 310. The resulting structure of the well barrier 300 is similar in appearance to a pair of overlapping umbrellas. The first and second canvas materials, 315 and 320, may also comprise other materials as will be apparent to a person of ordinary skill in the art having the benefit of this disclosure.

In the well barrier 300, the canvas materials, 315 and 320, provide the principle sealing function. Therefore the number of laths, 330 and 350, can be reduced and the spacing between the laths, 330 and 350, can be increased. The canvas materials, 315 and 320, are preferably arranged as bags with openings at the free ends, 335 and 355, of the laths 330 and 350, so that the fixing device 325 is located between the bottoms of the two bag-like structures.

The overlapping relationship of the first and second set of laths, 305 and 310, permits the overall length of the well barrier 300 to be reduced, but at the same time the lengths of the laths, 330 and 350, are sufficient to stabilize the well barrier 300 and prevent it from ending up in a sloping or transverse position in the well 120. Preferably, at least some part of the length of the free ends, 335 and 355, of the laths, 330 and 350, should run parallel and touch the wall of the well 120 for optimum stability in operation.

Figure 4:
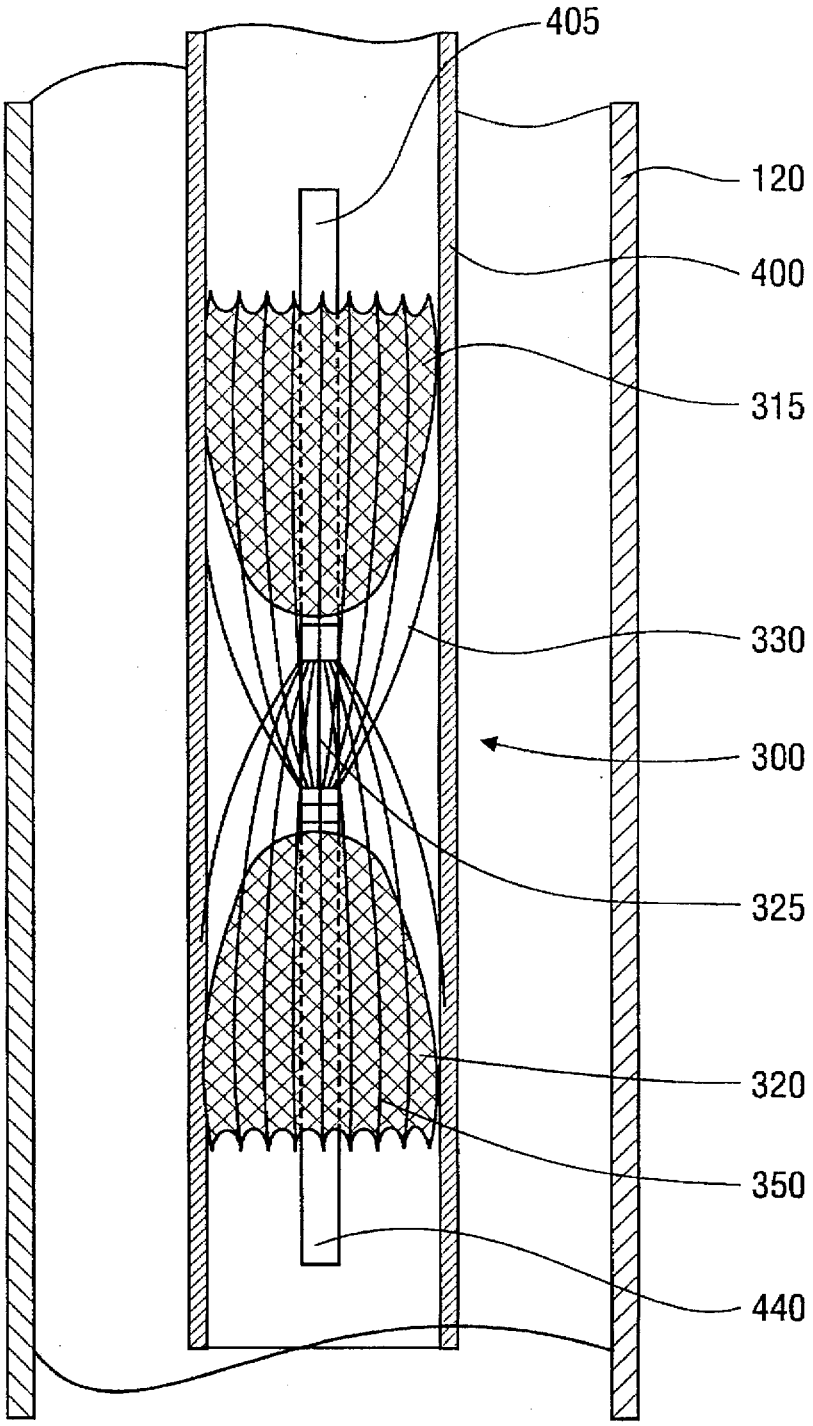
FIG. 4 illustrates a method of positioning the well barriers of FIGS. 1–3 within a well using a longitudinal center bar.

Referring now to FIG. 4, a method of placing a well barrier at a desired location within a well 120 will be described using the well barrier 300 as an illustrative embodiment. The well barrier 300 is preferably led down into the well 120 through a supply pipe 400 which is also used for supplying the cement mixture. It may be necessary to force the well barrier 300 through the supply pipe 400 by means of plugs, not shown, typically one plug in the front of and one plug in the back of the well barrier 300. The wall barrier 300 may then preferably be equipped with centrally located round bars, 405 and 440, which connect to the plugs mentioned, not shown, in order to prevent the laths, 330 and 350, or the canvas material, 315 and 320, from being damaged.

Figure 5:
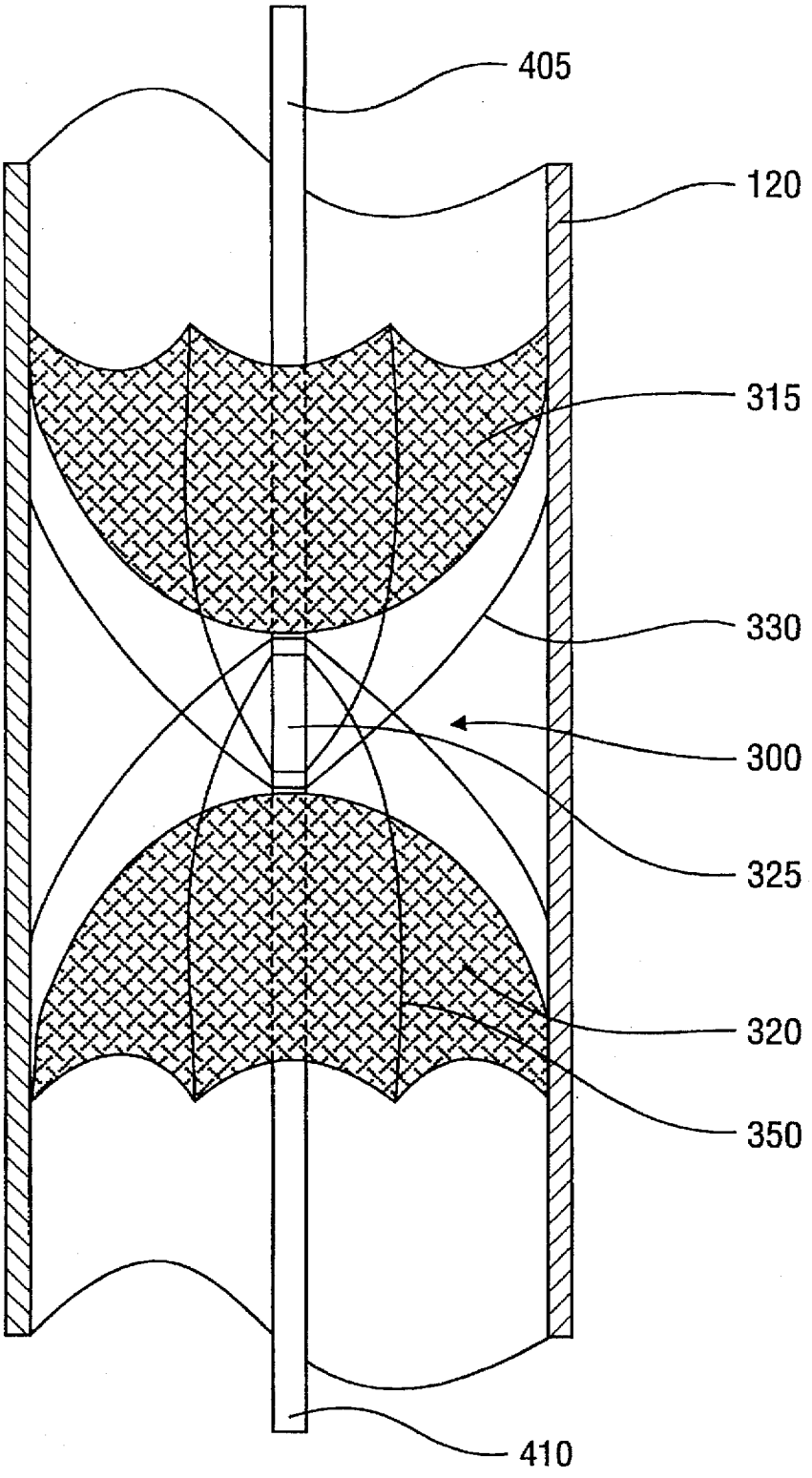
FIG. 5 further illustrates the method of positioning the well barriers of FIGS. 1–3 within a well.

The well barrier 300 is folded up in the supply pipe 400 and expands to fill up the cross section of the well 120 when the well barrier 300 leaves the supply pipe 400, because the laths, 330 and 350, are pre-compressed and springy as illustrated in FIG. 5.

After the well barrier 300 is placed in a well 120 and a cement mixture is supplied to the upper side of the laths 330, the cement mixture will, because of its greater density try to move the well barrier 300 downward. The laths 330 are forced against the wall of the well 120 and follow it. If the cement mixture is a thin liquid, the canvas material 315 will be strapped between the latches 330 as mentioned and the cement mixture will be collected by the canvas material 315 with the same result; the laths 330 and a part of the canvas material 315 is forced against the wall of the well 120.

A well barrier and method for placement of same within a well has been described which provides an improved well barrier capable of easy placement within a well at a desired location. The well barrier further provides a compact structure that minimizes space requirements while at the same time providing the required functionality.

While the invention is susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the appended claims.

What is claimed is:

1. A well barrier for the separation of two liquids in a gas or oil well, comprising:

(1) a fixing device;

(2) a first set of laths coupled to said fixing device projecting slantingly away from said fixing device in a first direction; and (3) a second set of laths coupled to said fixing device projecting slantingly away from said fixing device in a second direction;

wherein said first set of laths and said second set of laths are positioned in an overlapping relationship.

2. The well barrier of claim 1, wherein said first direction is substantially opposite to said second direction.

3. The well barrier of claim 1, wherein said first set of laths and said second set of laths run between one another.

4. The well barrier of claim 1, further comprising:

(1) a first canvas material coupled to said first set of laths; and (2) a second canvas material coupled to said second set of laths.

5. The well barrier of claim 1, further comprising:

(1) a first bag-like structure coupled to said first set of laths; and (2) a second bag-like structure coupled to said second set of laths.

6. The well barrier of claim 1, further comprising:

(1) an upper bar coupled to said fixing device and adapted for guiding said well barrier within a pipe; and (2) a lower bar coupled to said fixing device and adapted for guiding said well barrier within a pipe.

7. A method of placing a well barrier at a predetermined location within a well, comprising:

(1) placing a pipe within said well (2) guiding said well barrier within said pipe to said predetermined location within said well by forcing said well barrier through said pipe using a plug; and (3) placing said well barrier into intimate contact with said well at a plurality of discrete contact points at each of a plurality of discrete locations within said well.

8. The method of claim 7, wherein said well barrier includes a guide rod.

* * * * *